US007354266B2

(12) United States Patent
Miller et al.

(10) Patent No.: US 7,354,266 B2
(45) Date of Patent: Apr. 8, 2008

(54) REPLACEABLE LUMP BREAKER SYSTEM FOR A ROTARY KILN

(75) Inventors: Samuel A. Miller, Danville, PA (US); Neil R. Dock, Selinsgrove, PA (US); John D. Zerphey, Montoursville, PA (US); Glenn M. Hanson, III, Cumming, GA (US)

(73) Assignee: Metso Minerals Industries, Inc., Waukesha, WI (US)

( * ) Notice: Subject to any disclaimer, the term of this patent is extended or adjusted under 35 U.S.C. 154(b) by 171 days.

(21) Appl. No.: 11/342,051

(22) Filed: Jan. 27, 2006

(65) Prior Publication Data

US 2006/0172246 A1 Aug. 3, 2006

Related U.S. Application Data

(60) Provisional application No. 60/648,493, filed on Jan. 31, 2005.

(51) Int. Cl.
*F27B 7/14* (2006.01)

(52) U.S. Cl. ..... 432/118; 241/183

(58) Field of Classification Search ..... 432/118; 241/181, 183

See application file for complete search history.

(56) References Cited

U.S. PATENT DOCUMENTS 4,289,279 A * 9/1981 Brandt ..... 241/102
4,668,183 A * 5/1987 Patterson ..... 432/80
5,516,051 A * 5/1996 Brisbois et al. ..... 241/172
6,474,985 B1 11/2002 Miller et al.
6,705,859 B2 * 3/2004 McCarty ..... 432/118

OTHER PUBLICATIONS

"Lime Recovery Kiln Discharge End Grizzly Bar Lump Breaker System", Metso Minerals brochure.

* cited by examiner

*Primary Examiner*—Gregory Wilson
(74) *Attorney, Agent, or Firm*—Andrus, Sceales, Starke & Sawall, LLP

(57) ABSTRACT

A rotary kiln for pyroprocessing particulate material includes a cylindrical kiln shell supported for rotation about a longitudinal central axis. The kiln has a discharge opening that includes a lump breaker system. The lump breaker system includes multiple insert retainers mounted to the shell and positioned along the inner circumference of the rotary kiln. Each insert retainer includes multiple mounting slots for receiving breaker inserts that can be easily removed and replaced when worn. Each of the breaker inserts can be individually removed from its respective retainer without removing either the retainer or the layer of refractory in the rotary kiln.

18 Claims, 5 Drawing Sheets

REPLACEABLE LUMP BREAKER SYSTEM FOR A ROTARY KILN

CROSS REFERENCE TO RELATED APPLICATIONS

This application relates to and claims priority to U.S. Provisional Patent Application Ser. No. 60/648,493, filed Jan. 31, 2005.

BACKGROUND OF THE INVENTION

The present invention relates to rotary kilns, and more particularly to a lump breaking system for use at the discharge end of a rotary kiln to reduce the size of large particles prior to discharge. The device restricts the discharge of oversized agglomerations of processed material from the rotary kiln and reduces the size of the agglomerations to an acceptable size prior to discharge of the processed materials from the kiln.

A conventional rotary kiln includes a simple cylinder or shell installed at an incline. Raw material feed to be pyroprocessed is charged into the kiln from an inlet at the elevated end, and thereafter the feed material is typically calcinated by applying heat while the cylinder is rotated, and the calcinated product is discharged from an outlet at the exit or lower end of the kiln. Kilns of this type are well known in the art and are capable of treating raw materials of many different kinds and at a wide variety of particle sizes and shapes.

The hot pyroprocessed material exiting from the kiln is then typically cooled before further processing. Many different types of arrangements have been developed for cooling such material. When passing from the kiln to the cooling phase, a preferred maximum size of the product particles is desirable.

During typical operation, agglomerated "dust balls" often form within the kiln. An agglomerated dust ball must be broken up prior to discharge from the rotary kiln. Presently, various methods are known for breaking the dust balls into smaller sizes prior to discharge for further processing.

One example of a device for reducing the size of dust balls within a rotary kiln is shown and described in U.S. Pat. No. 6,474,985 entitled "Toothed Grate for Rotary Kiln Peripheral Discharge Opening". This device is particularly desirable for use on kilns with a peripheral discharge, typically into satellite or tube coolers. The device shown in the '985 patent includes a raised grate that fits within the peripheral openings in the kiln shell leading to the satellite or tube coolers. The raised grate has teeth formed on the device that break up the dust balls as they make contact with the grate during rotation of the kiln. The raised grate works in combination with a raised damn at the discharge end of the rotary kiln to prevent large particles from being discharged from the rotary kiln.

A second type of device for reducing the size of dust balls prior to discharge from a rotary kiln includes a series of one part castings that mount to the periphery of the discharge end of a refractory lined rotary kiln. The casting is typically bolted to the kiln shell, with the lower portion of the casting embedded in the refractory liner of the kiln. The casting includes multiple flat web portions that are perpendicular to the kiln axis and project above the refractory to act as a dust ball lump breaker. Although this type of system functions well to break the dust balls into a more manageable size, when the lump breaker portion of the design becomes worn or eroded after a period of use and needs replacement, the embedding refractory, mounting bolts and the entire casting must be removed and replaced.

It is thus desirable to provide an arrangement and system at the discharge end of a rotary kiln to break agglomerated dust balls into particles having reduced size that allows the operating components of the system to be easily removed and replaced without removing the refractory lining of the rotary kiln. It is additionally desirable to provide such a system that provides multiple sections such that worn portions of the system can be removed without requiring replacement of the entire system.

SUMMARY OF THE INVENTION

The present invention provides a system for reducing the size of particulate matter that is being pyroprocessed within a rotary kiln. The system includes of series of breaker inserts positioned at the discharge end of the rotary kiln such that as the rotary kiln rotates, the breaker inserts contact the accumulated balls of particulate material to reduce the size of the particulate material to an acceptable size prior to discharge from the rotary kiln.

The system includes a plurality of insert retainers that are each mounted to an inner surface of the rotary kiln shell near the discharge end of the kiln shell. Each insert retainer includes a mounting flange that is positioned in contact with the inner surface of the kiln shell and can be securely attached to the kiln shell by a series of connectors. Preferably, the insert retainers are equally spaced along the inner circumference of the kiln shell such that the series of insert retainers extend around the entire inner circumference.

Each of the insert retainers includes a series of mounting slots each sized to receive one of the breaker inserts. The mounting slots formed in the insert retainers each include a sloping back wall and a pair of side walls. A retaining projection extends across the mounting slot between the pair of spaced side walls to provide a point of connection for a breaker insert.

Each of the plurality of insert retainers is mounted to the cylindrical shell of the rotary kiln. A layer of refractory can be placed over the mounting flange of each insert retainer and between the mounting slots of each insert retainer. Thus, the insert retainer is positioned between the layer of refractory and the cylindrical kiln shell such that the insert retainer is fixed and designed not to be removed when replacing breaker inserts.

The mounting slots of each insert retainer removably receive one of a plurality of breaker inserts. Each of the breaker inserts, when installed in one of the insert retainers, extends radially toward the center of the open interior of the cylindrical kiln shell. Each breaker insert includes an upper end that has a series of teeth that contact the accumulated mass of particulate material as the rotary kiln rotates. Since each of the breaker inserts is removably mounted within the insert retainer, the breaker inserts can be independently removed and replaced upon damage or wear.

Each breaker insert includes an insertion notch that allows the breaker insert to be slid into the mounting slot. When the breaker insert is slid into position, the retaining projection of the mounting slot is received within the insertion notch of the breaker insert to retain the breaker insert within the mounting slots. Preferably, a retainer key is attached to the insertion notch of the breaker insert between the breaker insert and the insert retainer to further aid in retaining the breaker insert within the mounting slot.

During the construction of the rotary kiln, the series of insert retainers are mounted around the inner circumference of the cylindrical kiln shell prior to the placement of the refractory layer. The refractory layer is positioned over a portion of each of the insert retainers such that the insert retainers are securely held in position relative to the cylindrical kiln shell. Each of the mounting slots formed in the insert retainers is devoid of the refractory material such that each mounting slot can receive one of the breaker inserts.

When any of the breaker inserts become broken or worn, the individual breaker insert can be removed and replaced without having to remove either the insert retainer or any portion of the refractory layer.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
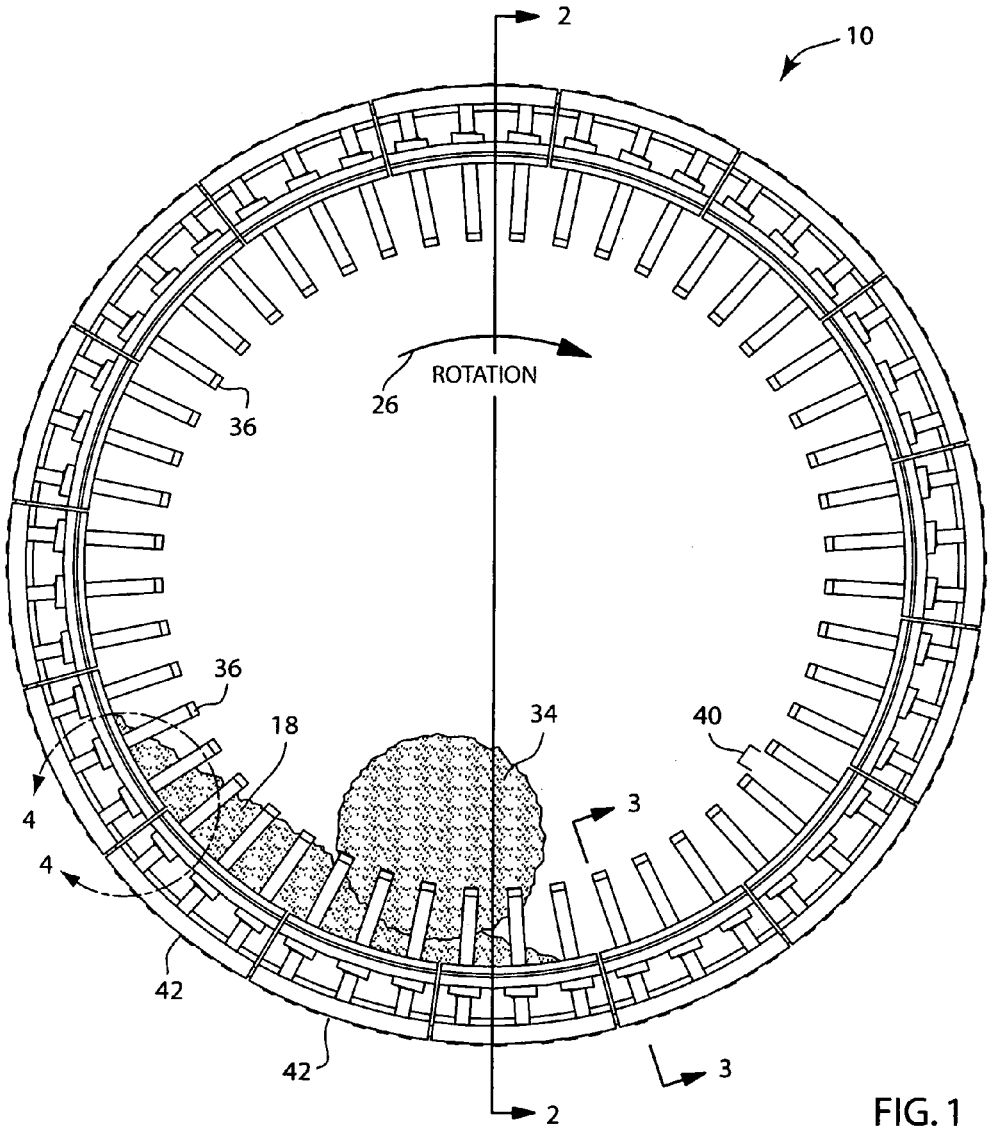
FIG. 1 is a front view of a rotary kiln incorporating the lump breaking system of the present invention.
Figure 2:
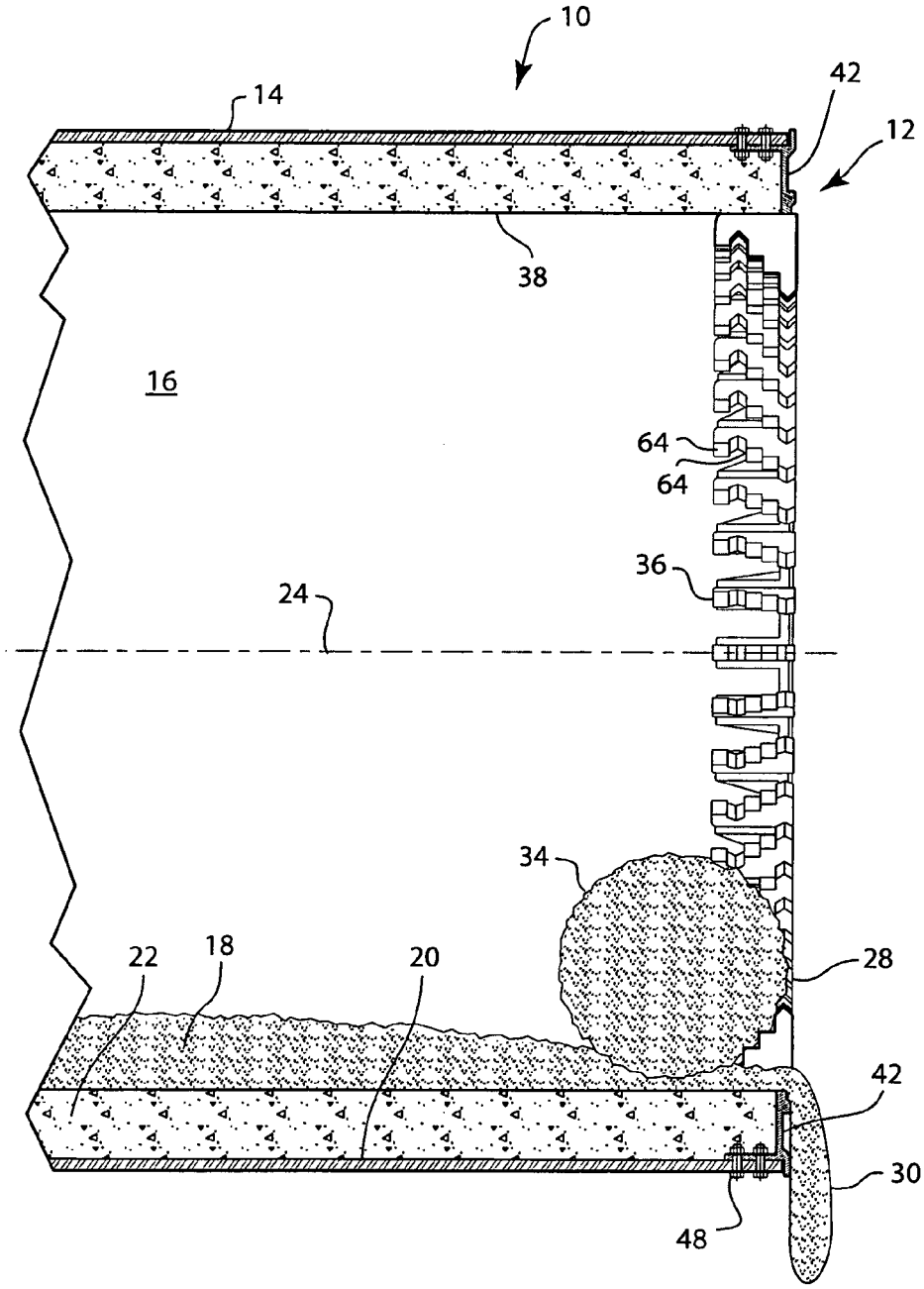
FIG. 2 is a section view taken along 2-2 of FIG. 1.

Referring now to the drawings, FIGS. 1-2 schematically illustrate a rotary kiln 10 that incorporates a lump breaker system 12 constructed in accordance with the present invention. In the present embodiment, the rotary kiln 10 may be used for recovery of lime from lime sludge generated in the pulp and paper industry. Basically, in lime recovery, lime containing sludge is calcinated or pyroprocessed to drive off carbon dioxide leaving calcium oxide in the form of lime pebbles and particles. A lime recovery kiln such as illustrated in FIGS. 1-2 is typically part of a system that may incorporate slurry pumping, dewatering, conveying and the like to prepare particulate material that is introduced as feed stock into one end thereof. Since there are numerous uses for rotary kilns, the use of the terms such as calcinating and/or pyroprocessing is not meant to be limiting and refers to only one example of the many potential uses for the rotary kiln 10 with which the lump breaker system 12 of the present invention may be incorporated.

As best illustrated in FIG. 2, the rotary kiln 10 includes an elongated cylindrical body or shell 14 that defines a cylindrical combustion chamber 16 for pyroprocessing the feed, which is schematically illustrated in FIG. 2 as material bed 18. The general arrangement and construction of rotary kilns of this type are well know to those skilled in the art and thus need not be described in detail. The inner wall 20 of the shell 14 may be lined with any suitable refractory material 22, such as fire bricks. Any well known means (not shown) may be provided for supporting and rotating the kiln 10 about its central axis 24 in a clockwise direction, as illustrated by arrow 26 in FIG. 1. A charge of raw material to be processed is fed into the upstream or inlet end of the kiln. Since the kiln is inclined with respect to a horizontal plane, the feed material moves downwardly towards discharge end 28. As illustrated in FIG. 2, the raw material 18 to be pyroprocessed slowly travels by gravity through the combustion chamber 16 as the cylindrical body or shell 14 rotates. Processed product 30 is discharged for further downstream processing.

As illustrated in FIG. 2, oversized agglomerated masses of product, referred to as dust balls 34, can be created within the combustion chamber 16. Since the dust balls 34 are much larger than the desired particles to be discharged from the rotary kiln, the lump breaker system 12 of the present invention is installed at the discharge end 28 of the rotary kiln 10. The lump breaker system 12 functions to break particles from the dust balls 34 until the particles are of a sufficiently small size to be discharged.

As illustrated in FIGS. 1 and 2, the lump breaker system 12 of the present invention includes a series of spaced breaker inserts 36 extending around the inner circumference of the rotary kiln 10. Specifically, each of the breaker inserts 36 extends above the inner wall 38 defined by the layer of refractory 22 to reduce the effective diameter at the discharge opening 28 of the rotary kiln 10. As best illustrated in FIG. 1, each of the breaker inserts 36 is spaced from its adjacent breaker insert by a discharge passageway 40 that defines the maximum particle size that can exit the discharge opening 28 of the rotary kiln.

Figure 3:
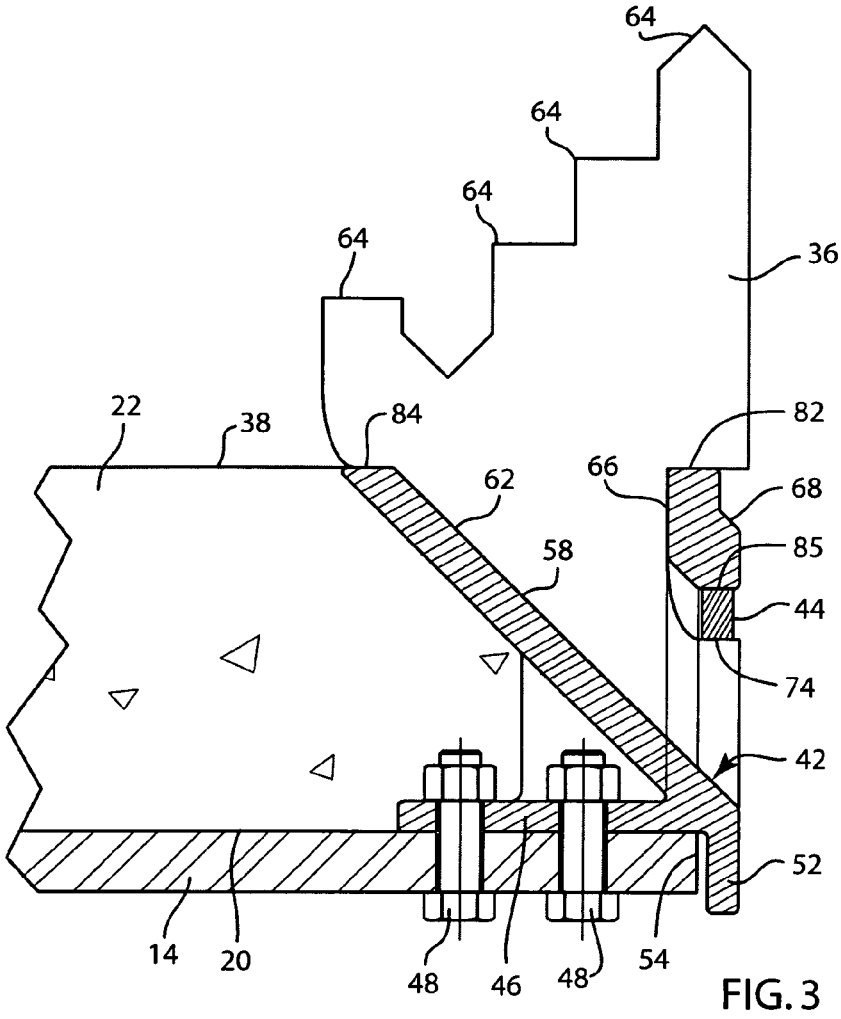
FIG. 3 is a section view of the rotary kiln taken along line 3-3 of FIG. 1.
Figure 5:
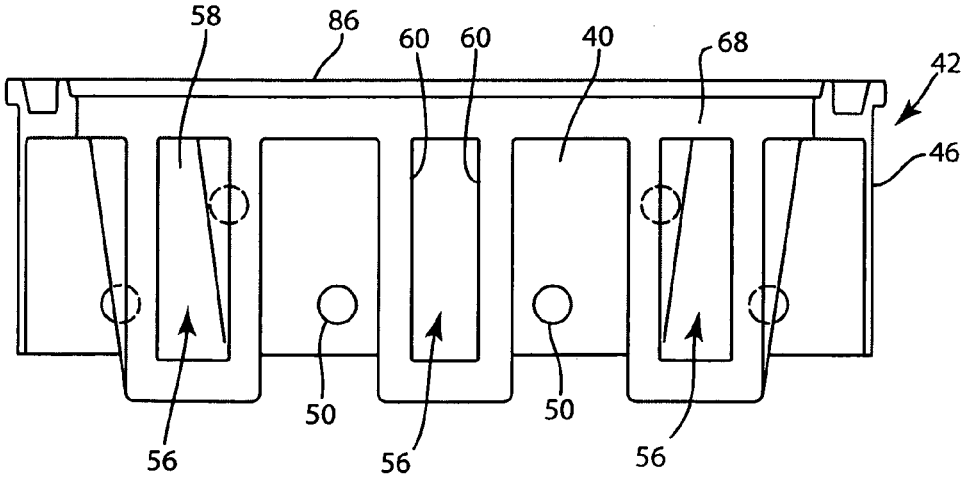
FIG. 5 is a top view of a section of the insert retainer used in accordance with the present invention.

Referring now to FIGS. 3 and 5, the lump breaker system includes an insert retainer 42, a plurality of breaker inserts 36 and an insert retainer key 44 for each breaker insert 36. As shown in FIG. 3, the insert retainer 42 includes a mounting flange 46 that contacts the inner wall 20 of the outer shell 14 near the discharge end of the rotary kiln. The mounting flange 46 is positioned below the layer of refractory material 22 and is secured to the outer shell 14 by a series of connectors 48. As illustrated in FIG. 5, the insert retainer 42 includes multiple openings 50 in the mounting flange 46 to facilitate mounting of the insert retainer to the outer shell 14. Referring back to FIG. 3, the insert retainer 42 preferably includes an outer lip 52 that engages the outermost edge 54 of the shell 14.

As illustrated in FIGS. 1 and 3, in the preferred embodiment of the invention, the lump breaker system 12 includes multiple individual insert retainer sections 42 spaced along the inner circumference of the rotary kiln 10. The multiple insert retainer sections 42 allow the insert retainer sections 42 to be more easily mounted to the inner surface of the shell of the rotary kiln. In the embodiment of the invention illustrated, each of the retainer sections 42 supports three of the breaker inserts 36. However, it is contemplated that the size of the retainer sections 42 could be either increased or decreased to support more or less than the three breaker inserts 36 shown in the preferred embodiment of the invention.

Referring back to FIG. 5, the insert retainer 42 includes three mounting slots 56 that are separated from each other by a void that will receive refractory. Each of the mounting slots 56 includes a sloping back wall 58, as illustrated in FIGS. 3 and 5. The sloping back wall 58 is laterally bounded by a pair of side walls 60. The side walls 60, in combination with the sloping back wall 58, define a cavity for receiving one of the breaker inserts 36.

Figure 7:
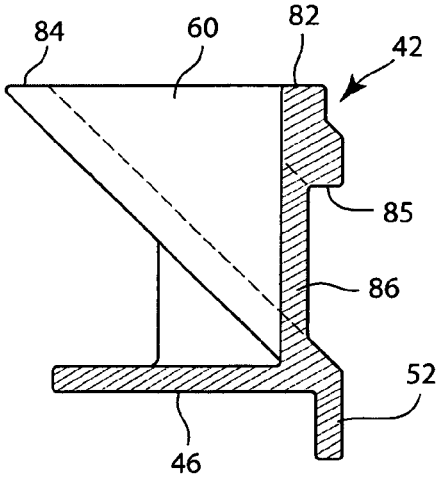
FIG. 7 is a section view taken along line 7-7 of FIG. 6.
Figure 8:
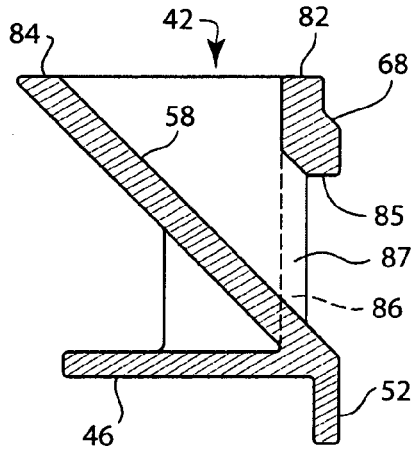
FIG. 8 is a section view taken along line 8-8 of FIG. 6.

As best shown in FIGS. 7 and 8, a front wall 86 extends between the mounting slots 56. The front wall 86 is removed within each of the mounting slots 56 to define the insert opening 87.

Figure 9:
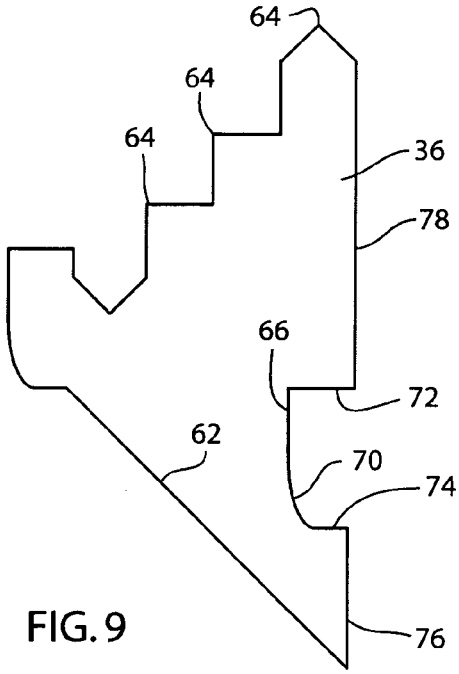
FIG. 9 is a side view of the breaker insert.
Figure 6:
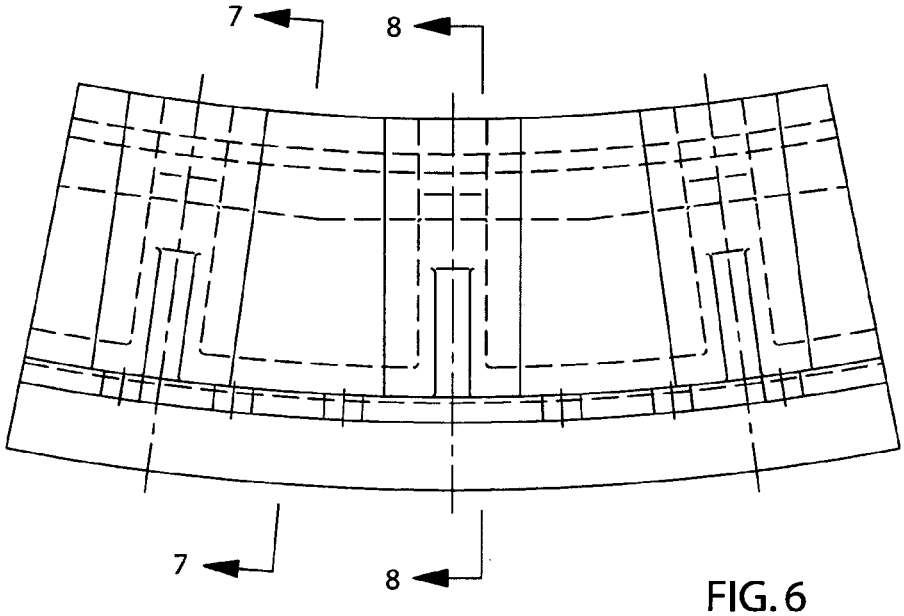
FIG. 6 is a back view of the insert retainer.

Referring now to FIGS. 3 and 9, each of the breaker inserts 36 is a generally flat blade constructed from a durable metallic material. The breaker insert 36 includes a sloping bottom wall 62 that corresponds to the slope of the back wall 58 of the insert retainer 42. Thus, when the breaker insert 36 is supported as shown in FIG. 3, the sloping bottom wall 62 smoothly engages the sloping back wall 58 of the insert retainer 42.

The breaker insert 36 further includes multiple teeth 64 that extend into the combustion chamber 16, as best shown in FIG. 2. The teeth 64 are configured such that the rotary action of the kiln and the kiln sloping downward towards the discharge opening 28 will bring the dust balls 34 into contact with the teeth 64 of the breaker insert 36 at the discharge opening 28. As can be understood in FIG. 3, the height of the breaker insert 36 above the inner wall 38 of the refractory 22 prevents dust balls from discharging from the kiln. The repeated contact between the oversized dust balls 34 and the breaker inserts 36 will break off pieces of the dust balls that are small enough to pass between the spaced breaker inserts and discharge from the kiln.

Referring back to FIGS. 3 and 9, the breaker insert 36 includes an insertion notch 66 that receives a retaining projection 68 formed as part of the insert retainer 42. Specifically, the retaining projection 68 is defined by the wall extending between the pair of side walls 60 that define each of the mounting slots 56. As illustrated in FIG. 9, the insertion notch 66 includes a curved back wall 70 that extends between the generally straight top wall 72 and a generally straight bottom wall 74. The curvature of the back wall 70 allows the breaker insert 36 to be rotated into the position shown in FIG. 3.

Figure 4:
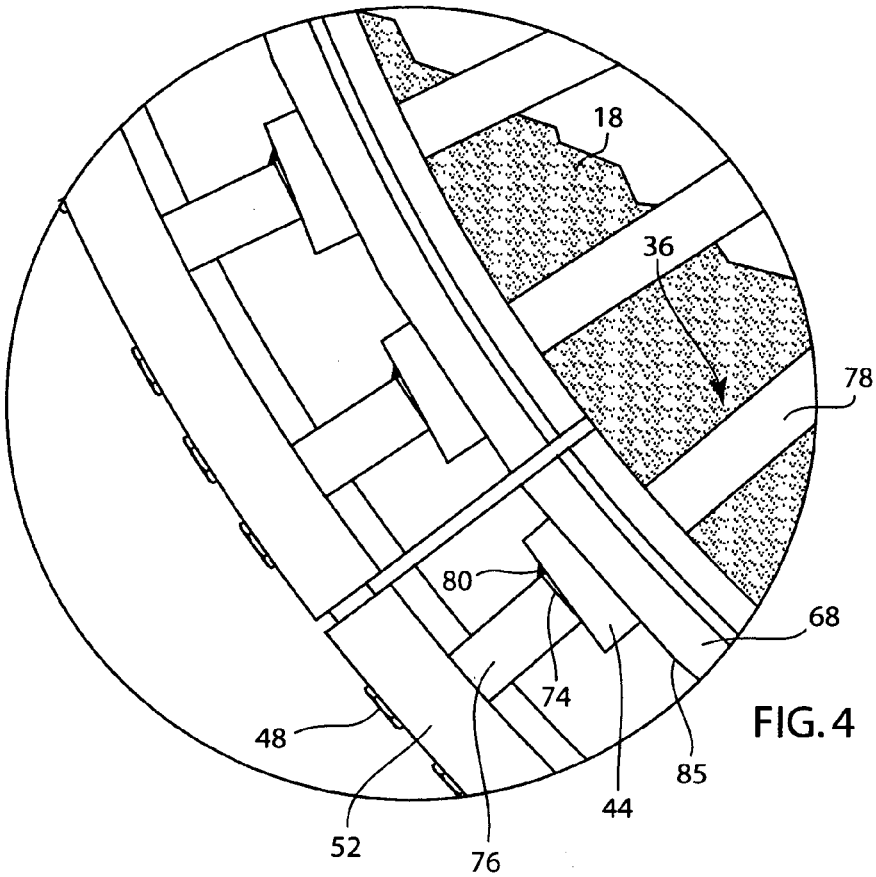
FIG. 4 is a magnified view taken along line 4-4 of FIG. 1.
Figure 10:
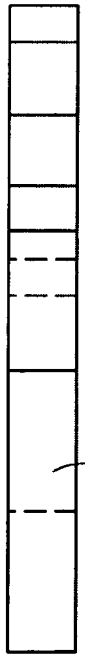
FIG. 10 is a back view of the breaker insert.

Once the breaker insert 36 is inserted as shown in FIG. 3, the retainer key 44 is welded to the bottom wall 74 of the breaker insert 36. When the key 44 is welded as shown in FIG. 4, the breaker insert 36 is held in place with respect to the insert retainer 42. As can be seen in FIG. 4, the retainer key 44 is positioned between surface 74 of the breaker insert 36 and below lower surface 85 on the retaining projection 68. As illustrated, a weld 80 secures the retainer key 44 to the breaker insert 36. The upper face 78 of the breaker insert 36 extends radially inward past the retaining projection 68 and into the product flow 18.

Referring back to FIG. 3, the inner wall 38 of the refractory material 22 is generally aligned with the top surface of the insert retainer 42, as defined by the top surface 82 of the retainer projection 68 and the top surface 84 of the sloping back wall 58. Thus, only the toothed portions 64 of the breaker inserts 36 extend past the inner surface 38 of the refractory 22. If particles having a size smaller than the circumferential space between the breaker inserts reach the discharge end, the particles will be allowed to pass through the discharge end as desired. However, the series of breaker inserts 36 prevent the discharge of larger dust balls 34 in the manner described previously.

During the initial manufacture of the rotary kiln 10, the series of insert retainers 42 are securely attached around the inner circumference of the shell 14 using the connectors 48. Once the series of insert retainers 42 are attached to the outer shell 14, as best shown in FIGS. 1 and 2, the layer of refractory material 22 is installed. As illustrated in FIG. 3, the layer of refractory material 22 is not present in the mounting slots 56 formed in each of the insert retainers 42.

Once the refractory layer 22 and the series of insert retainers 42 are installed, the plurality of individual breaker inserts 36 can be installed into the insert retainers. As described, each of the breaker inserts 36 is installed by sliding the insert 36 until the retaining projection 68 of the insert retainer 42 is received within the insertion notch 66, as best illustrated in FIG. 3. Once the breaker insert 36 is properly positioned, the retainer key 44 is welded to the bottom wall 74 of the breaker insert 36 to securely hold the breaker insert in place.

As illustrated in FIGS. 2 and 3, since each of the breaker inserts 36 is replaceable, when any of the breaker inserts 36 becomes worn, the individual breaker insert 36 can be removed and simply replaced. As can be understood, replacement of the breaker inserts 36 does not require the removal of either the insert retainer 42 or any portion of the refractory material 22. Thus, the lump breaker system of the present invention allows for easy removal and replacement of worn materials without requiring the removal of any refractory material.

In the preferred embodiment of the invention, both the insert retainers 42 and the breaker inserts 36 are formed from a durable material, such as steel. However, it is contemplated that other materials could be used while operating within the scope of the present invention.

Various alternatives and embodiments are contemplated as being within the scope of the following claims particularly pointing out and distinctly claiming the subject matter regarded as the invention.

What is claimed is:

1. A rotary kiln for pyroprocessing particulate material, comprising:

a cylindrical kiln shell mounted for rotation about a central axis, the kiln shell having an input end and a discharge end and being inclined downwardly toward the discharge end enabling the particulate material to be pyroprocessed within an open interior of the kiln shell as the kiln shell rotates;

a plurality of insert retainers each mounted to the kiln shell near the discharge end of the kiln shell, each insert retainer including a plurality of mounting slots each having a pair of spaced sidewalls defining a receiving cavity; and a plurality of breaker inserts each receivable within one of the receiving cavities of the plurality of mounting slots such that the breaker inserts extend radially into the open interior of the kiln shell, each of the breaker inserts being removably mounted within one of the mounting slots such that each of the breaker inserts can be independently removed and replaced from within the receiving cavities of the insert retainer.

2. The rotary kiln of claim 1 wherein each of the mounting slots includes a retaining projection received within an insertion notch of the breaker insert to retain the breaker insert within one of the mounting slots.

3. The rotary kiln of claim 2 further comprising a retainer key attached to the insertion notch of the breaker insert when the breaker insert is within the mounting slot, the retainer key being positioned between the retaining projection and the insertion notch to retain the breaker insert within the mounting slot.

4. The rotary kiln of claim 1 further comprising a layer of refractory positioned along an inner surface of the kiln shell from the infeed end to the discharge end, wherein the layer of refractory is positioned between the mounting slots of each of the insert retainers.

5. The rotary kiln of claim 4 wherein each of the insert retainers includes a mounting flange positioned in contact with an inner surface of the kiln shell at the discharge end, the mounting flange being attached to the kiln shell to secure the insert retainer to the kiln shell.

6. The rotary kiln of claim 5 wherein the mounting flange is positioned between the layer of refractory and the inner surface of the kiln shell.

7. The rotary kiln of claim 4 wherein each of the breaker inserts includes an upper end extending past the layer of refractory and into the open interior of the kiln shell.

8. The rotary kiln of claim 7 wherein the upper end of each breaker insert includes a plurality of teeth.

9. The rotary kiln of claim 4 wherein each of the insert retainers includes a top surface generally aligned with an inner wall of the layer of refractory, wherein each of the breaker inserts extends past the inner wall of the layer of refractory.

10. The rotary kiln of claim 1 wherein the plurality of insert retainers are uniformly spaced around the entire inner circumference of the kiln shell.

11. The rotary kiln of claim 1 wherein the mounting slots are separated from each other to establish a discharge passageway between breaker inserts, wherein each discharge passageway allows particulate material to exit the discharge end of the kiln shell.

12. A system for reducing the size of particulate material in a rotary kiln having a cylindrical kiln shell extending from an infeed end to a discharge end, the system comprising:

a plurality of insert retainers each configured for mounting to the kiln shell at the discharge end of the kiln shell, each insert retainer including a plurality of mounting slots each having a pair of spaced sidewalls defining a receiving cavity; and a plurality of breaker inserts each removably mounted within one of the receiving cavities of one of the mounting slots, each of the breaker inserts being configured to extend into an open interior of kiln shell when mounted within one of the mounting slots such that the breaker inserts contact the particulate material to reduce the size of the particulate material as the kiln shell rotates, wherein each of the breaker inserts are independently removable and replaceable from the insert retainer.

13. The system of claim 12 wherein each of the mounting slots includes a retaining projection received within an insertion notch of the breaker insert to retain the breaker insert within one of the mounting slots.

14. The system of claim 13 further comprising a retainer key attached to the insertion notch of the breaker insert when the breaker insert is within the mounting slot, the retainer key being positioned between the retaining projection and the insertion notch to retain the breaker insert within the mounting slot.

15. The system of claim 12 wherein the rotary kiln includes a layer of refractory positioned along an inner surface of the rotary kiln, wherein each of the insert retainers includes a mounting flange positionable in contact with an inner surface of the kiln shell and beneath the layer of refractory at the discharge end of the kiln shell.

16. The system of claim 12 wherein each of the breaker inserts includes an upper end having a plurality of teeth and configured to extend into the open interior of the kiln shell.

17. The system of claim 12 wherein in the mounting slots are separated from each other to establish a discharge passageway between breaker inserts to permit particulate matter to exit the discharge end of the kiln shell.

18. The system of claim 12 wherein the plurality of insert retainers are uniformly spaced along the inner circumference of the kiln shell.

* * * * *